US010492989B2

(12) United States Patent
Li et al.

(10) Patent No.: US 10,492,989 B2
(45) Date of Patent: Dec. 3, 2019

(54) RECONSTITUTION OF PHARMACEUTICALS FOR INJECTION

(71) Applicant: Massachusetts Institute of Technology, Cambridge, MA (US)

(72) Inventors: Xiang Li, Ypsilanti, MI (US); Benjamin E. Maimon, Westfield, NJ (US); Ho-Jun Suk, Cambridge, MA (US); John Robert Lewandowski, Shaker Heights, OH (US); Adam David Sachs, Newton, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 805 days.

(21) Appl. No.: 14/252,645

(22) Filed: Apr. 14, 2014

(65) Prior Publication Data

US 2015/0290078 A1 Oct. 15, 2015

(51) Int. Cl.

| | |
|---|---|
| ***A61J 1/20*** | (2006.01) |
| ***A61J 1/14*** | (2006.01) |
| *A61M 5/178* | (2006.01) |

(52) U.S. Cl.

CPC ..... *A61J 1/1406* (2013.01); *A61J 1/2096* (2013.01); *A61J 1/2072* (2015.05); *A61M 5/1782* (2013.01)

(58) Field of Classification Search

CPC ..... A61J 1/1406; A61J 1/2072; A61J 1/2096; A61M 5/1782

See application file for complete search history.

(56) References Cited

U.S. PATENT DOCUMENTS

| | | | |
|---|---|---|---|
| 1,625,035 | A | 4/1927 | Lilly |
| 3,542,023 | A | 11/1970 | Ogle |
| 3,739,947 | A | 6/1973 | Baumann et al. |
| 4,243,080 | A | 1/1981 | Penny et al. |
| 4,286,389 | A | 9/1981 | Ogle |
| 4,516,967 | A | 5/1985 | Kopfer et al. |
| 4,717,384 | A | 1/1988 | Waldeisen et al. |

(Continued)

FOREIGN PATENT DOCUMENTS

| | | |
|---|---|---|
| CA | 2745320 | 1/2013 |
| CA | 2783251 | 1/2014 |

(Continued)

OTHER PUBLICATIONS

U.S. Searching Authority, "International Application Serial No. PCT/US15/24610, Search Report and Written Opinion dated Sep. 11, 2015", 15 pages.

(Continued)

*Primary Examiner* — Kai H Weng

(74) *Attorney, Agent, or Firm* — Strategic Patents, P.C.

(57) ABSTRACT

A device is disclosed for reconstitution and delivery of an injectable pharmaceutical. A diluent is provided in a pressurized reservoir, while separately a syringe with a needle contains a pharmaceutical such as a lyophilized drug. When the pressurized reservoir is coupled to the interior of the syringe, such as by piercing the pressurized reservoir with the needle, the pressurized reservoir forces the diluent into the syringe where the diluent can mix with and reconstitute the pharmaceutical. A variety of techniques are disclosed for pressurizing the reservoir and fluidly coupling the reservoir with the syringe. The techniques disclosed herein may, for example, be adapted for use with a conventional syringe and needle.

20 Claims, 8 Drawing Sheets

(56) References Cited

U.S. PATENT DOCUMENTS

| | | | |
|---|---|---|---|
| 4,767,008 | A | 8/1988 | Warnecke et al. |
| 4,997,430 | A | 3/1991 | Van et al. |
| 5,281,198 | A | 1/1994 | Haber et al. |
| 5,433,330 | A | 7/1995 | Dudar et al. |
| 5,779,668 | A | 7/1998 | Grabenkort |
| 6,341,718 | B1 | 1/2002 | Schilthuizen et al. |
| 6,349,850 | B1 | 2/2002 | Cheikh |
| 6,645,171 | B1 | 11/2003 | Robinson et al. |
| 7,959,600 | B2 | 6/2011 | Chang et al. |
| 8,137,307 | B2 | 3/2012 | Phipps et al. |
| 8,186,511 | B2 | 5/2012 | Timm et al. |
| 8,323,237 | B2 | 12/2012 | Radmer et al. |
| 8,343,130 | B2 | 1/2013 | Green |
| 8,361,035 | B2 | 1/2013 | Thorley et al. |
| 8,425,453 | B2 | 4/2013 | Chang |
| 8,522,842 | B2 | 9/2013 | Sharkey et al. |
| 8,636,689 | B2 | 1/2014 | Simpson et al. |
| 8,680,088 | B2 | 3/2014 | Hicks, Jr. et al. |
| 2003/0105430 | A1 | 6/2003 | Lavi et al. |
| 2006/0106340 | A1 | 5/2006 | Goossens et al. |
| 2006/0259020 | A1 | 11/2006 | Sharratt et al. |
| 2009/0131864 | A1 | 5/2009 | Pickhard |
| 2009/0275888 | A1 | 11/2009 | Kriesel et al. |
| 2011/0098676 | A1 | 4/2011 | Chiang et al. |
| 2012/0041366 | A1 | 2/2012 | Fayyaz et al. |
| 2012/0078172 | A1 | 3/2012 | Bendek et al. |
| 2013/0035664 | A1 | 2/2013 | Mojdehbakhsh et al. |
| 2013/0060191 | A1 | 3/2013 | Thorley et al. |
| 2013/0261046 | A1 | 10/2013 | Chang et al. |
| 2014/0066846 | A1 | 3/2014 | Genosar et al. |
| 2014/0308293 | A1 | 10/2014 | Vos et al. |
| 2015/0029816 | A1 | 1/2015 | Beyer et al. |
| 2016/0271018 | A1 | 9/2016 | Li et al. |

FOREIGN PATENT DOCUMENTS

| | | |
|---|---|---|
| EP | 2123316 | 11/2009 |
| WO | WO-1997020536 | 6/1997 |
| WO | WO-2001087385 | 11/2001 |
| WO | WO-2013132414 | 9/2013 |
| WO | WO-2015160563 | 10/2015 |
| WO | WO-2016149457 | 9/2016 |

OTHER PUBLICATIONS

"U.S. Appl. No. 14/660,639 Notice of Allowance dated May 9, 2018", 14 pages.

"U.S. Appl. No. 14/660,639, Non-Final Office Action dated Apr. 7, 2017", 18 pages.

"U.S. Appl. No. 14/660,639 Final Office Action dated Sep. 11, 2017", 18 pages.

EPO, "EP Application No. 15779247.4 EP Search Report dated Nov. 2, 2017", 8 pages.

WIPO, "PCT Application No. PCT/US16/22782 International Preliminary Report on Patentability dated Sep. 28, 2017", 12 pages.

ISA, "PCT Application No. PCT/US16/22782 International Search Report and Written Opinion dated Jun. 10, 2016", 14 pages.

"U.S. Appl. No. 14/660,639 Notice of Allowance dated Jul. 20, 2018", 9 pages.

IP Australia, "AU Application No. 2015248063 First Examination Report dated Feb. 19, 2019", 4 pages.

RECONSTITUTION OF PHARMACEUTICALS FOR INJECTION

TECHNICAL FIELD

The present disclosure generally relates to reconstitution of a pharmaceutical for injection, and more specifically to devices, systems, kits, and methods for reconstituting and injecting a pharmaceutical.

BACKGROUND

Some pharmaceuticals such as lyophilized pharmaceuticals require reconstitution immediately prior to use. This may impose particular challenges when such pharmaceuticals are intended for home use. For example, patients may be expected to manually reconstitute a lyophilized drug with bacteriostatic water (while being mindful of sterile techniques), a process requiring significant time and attention with current techniques. There is a need for improved devices, systems, kits, and methods for the reconstitution of a pharmaceutical for injection that may, inter alia, reduce training time and skill required to use, improve patient compliance, and decrease human error.

SUMMARY

A device is disclosed for reconstitution and delivery of an injectable pharmaceutical. A diluent is provided in a pressurized reservoir, while separately a syringe with a needle contains a pharmaceutical such as a lyophilized drug. When the pressurized reservoir is coupled to the interior of the syringe, such as by piercing the pressurized reservoir with the needle, the pressurized reservoir forces the diluent into the syringe where the diluent can mix with and reconstitute the pharmaceutical. A variety of techniques are disclosed for pressurizing the reservoir and fluidly coupling the reservoir with the syringe. The techniques disclosed herein may, for example, be adapted for use with a conventional syringe and needle.

In one aspect, a device for reconstituting a pharmaceutical includes a fluid reservoir with an opening. The fluid reservoir may be sized to contain an amount of fluid to reconstitute a dose of the pharmaceutical. The device may also include a seal forming a pierceable, self-sealing cover for the opening, and a moving seal within the fluid reservoir. The device may further include a stored energy mechanism configured to pressurize an interior of the fluid reservoir by applying a force to the moving seal.

In another aspect, a device includes a fluid reservoir with an opening. The fluid reservoir may include an elastic wall configured to pressurize an incompressible fluid within the fluid reservoir. The device may also include a needle and a syringe, where the syringe has an interior containing a pharmaceutical. The device may further include a seal forming a pierceable, self-sealing cover to seal the opening against passage of the fluid at or above a pressure applied by the elastic wall. The needle may be positioned to partially breach the seal to form a barrier between an interior of the fluid reservoir and the interior of the syringe to concurrently and separately retain the fluid in the reservoir and the pharmaceutical in the syringe.

In yet another aspect, a method includes: providing a syringe having a barrel and a needle; disposing a pharmaceutical within an interior of the barrel; inserting a plunger into the barrel to retain the pharmaceutical within the barrel on a first end; inserting a seal into an opening in a fluid reservoir; placing the needle into the seal to retain the pharmaceutical within the barrel on a second end thereby providing an assembly containing the pharmaceutical; and packaging the assembly in a package for disposable single use.

In another aspect, a method includes: providing a syringe having a barrel and a needle; inserting a seal into an opening in a fluid reservoir; placing the needle into the seal a distance sufficient to close a first end of the barrel without a tip of the needle entering an interior of the fluid reservoir; adding a fluid to the interior of the fluid reservoir; pressurizing the fluid in the fluid reservoir, thereby providing an assembly including the syringe, the seal, and the fluid reservoir with a pressurized fluid; and packaging the assembly in a package for disposable single use.

In yet another aspect, a method includes: providing a pharmaceutical retained in a barrel of a syringe by a plunger, where the syringe further includes a needle; adding a fluid to a reservoir, where the fluid is selected to reconstitute the pharmaceutical; pressurizing the fluid in the reservoir at a pressure sufficient to drive the fluid through the needle into the barrel, thereby providing a pressurized reservoir; inserting a tip of the needle into the pressurized reservoir; retaining the needle and syringe with the tip inserted into the pressurized reservoir while the fluid in the pressurized reservoir drives the plunger away from the needle and fills the barrel; and removing the tip of the needle from the pressurized reservoir.

In another aspect, a kit includes a syringe, one or more needles fitted to the syringe, a plunger fitted to the syringe, and a vessel for a reconstituting fluid. The vessel may include a reservoir with an opening, a seal forming a pierceable, self-sealing cover for the opening, a moving seal within the reservoir, and a stored energy mechanism configured to pressurize a fluid within the reservoir by applying a force to the moving seal.

BRIEF DESCRIPTION OF THE DRAWINGS

The foregoing and other objects, features, and advantages of the devices, systems, kits, and methods described herein will be apparent from the following description of particular embodiments thereof, as illustrated in the accompanying drawings. The drawings are not necessarily to scale, emphasis instead being placed upon illustrating the principles of the devices, systems, kits, and methods described herein.

DETAILED DESCRIPTION

Figure 1:
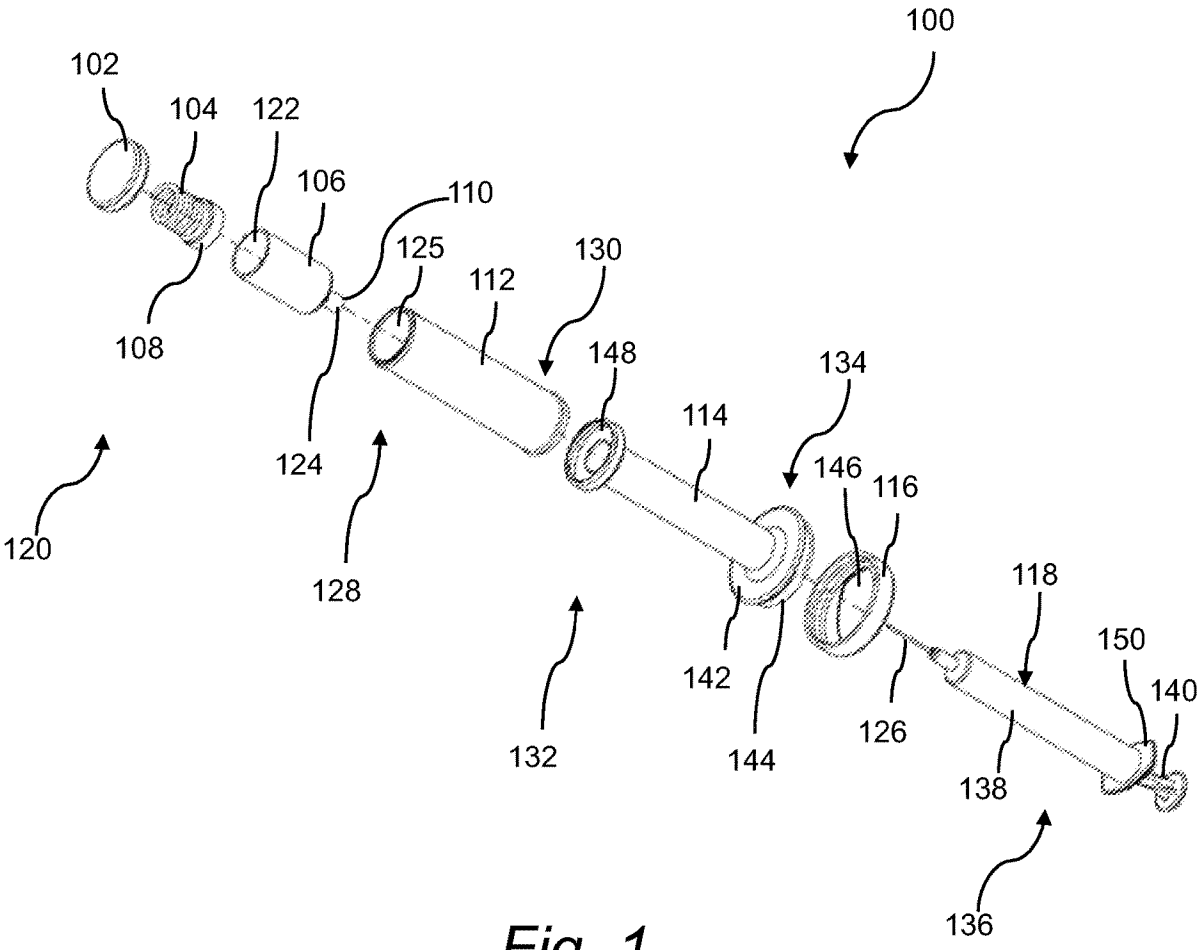
FIG. 1 is an exploded view of a device with a moving seal.

The embodiments will now be described more fully hereinafter with reference to the accompanying figures, in which preferred embodiments are shown. The foregoing may, however, be embodied in many different forms and should not be construed as limited to the illustrated embodiments set forth herein. Rather, these illustrated embodiments are provided so that this disclosure will convey the scope to those skilled in the art.

All documents mentioned herein are hereby incorporated by reference in their entirety. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values herein are not intended to be limiting, referring instead individually to any and all values falling within the range, unless otherwise indicated herein, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments. No language in the specification should be construed as indicating any unclaimed element as essential to the practice of the embodiments.

In the following description, it is understood that terms such as "first," "second," "distal," "proximal," "top," "bottom," "above," "below," and the like, are words of convenience and are not to be construed as limiting terms.

Described herein are devices, systems, kits, and methods for reconstituting a pharmaceutical, and in some aspects, injecting the pharmaceutical. Any reference to "pharmaceuticals," "drugs," "injectables," and the like, will be generally understood to include any item to be injected, e.g., through a syringe or the like. For example, the pharmaceutical may include, without limitation, proteins, peptides, biologics, vaccines, enzymes, microorganisms, monoclonal antibodies, parenterals, pharmaceuticals, blood fractions, oglionucleotides, blood plasma, diagnostics, nutraceuticals, cosmeceuticals, biomaterials, and so on. The pharmaceutical may be in powder form. The pharmaceutical may require reconstituting, rehydration, mixing, or the like, to place the pharmaceutical into an injectable form. The pharmaceutical may include a lyophilized pharmaceutical. A lyophilized pharmaceutical will be generally understood to be any drug (or other injectable) that has undergone a freeze-drying process or the like, or more generally any drug that requires reconstituting, rehydration, mixing, or the like, to place the drug into an injectable form. By way of example, the lyophilized pharmaceutical may include injectable human chorionic gonadotropin (hCG), e.g., to treat hypogonadism. By way of another example, the lyophilized pharmaceutical may include an immunoresponsive biologic. The immunoresponsive biologic may include a vaccination.

More generally, the systems and methods described herein may be usefully employed in any context where an injectable composition might be usefully prepared for storage or transportation in a lyophilized, concentrated, dehydrated, or other reconstitutable form.

FIG. 1 is an exploded view of a device with a moving seal. The device 100 may generally be a device for reconstituting and injecting a pharmaceutical. The device 100 may provide a complete "once-and-done" system for any injectable (e.g., injectable pharmaceutical). The device 100 may be partially disposable, completely disposable, or non-disposable. The device 100 may also or instead be a single-dose or multi-dose device. The device 100 may be adapted to a full range of injectables including pharmaceutical products requiring reconstitution.

The device 100 may include a distal cap 102, a stored energy mechanism (e.g., a spring 104), a fluid reservoir 106, a moving seal 108, a fluid reservoir seal 110, a first shaft 112, a second shaft 114, a proximal cap 116, and a syringe 118.

The distal cap 102 may generally include a cap for the distal end 120 of the device 100. The distal cap 102 may be permanently or releasably coupled to the stored energy mechanism (e.g., the spring 104), or otherwise engaged with the stored energy mechanism. The distal cap 102 may be removably and replaceably coupled to the fluid reservoir 106. The distal cap 102 may also be coupled to the moving seal 108, where removing the distal cap 102 may also remove the moving seal 108 thereby providing access to a chamber 122 within the fluid reservoir 106. Alternatively, the distal cap 102 may be permanently attached to the fluid reservoir 106. In this manner, placing the distal cap 102 on the distal end 120 of the device 100 may compress the spring 104 thereby applying a force to the moving seal 108. The distal cap 102 may be configured to engage the stored energy mechanism with the moving seal 108 when coupled to the fluid reservoir 106. The distal cap 102 may include a screw thread that engages with a corresponding screw thread on the first shaft 112 in order to provide a stable and consistent interaction between these components. Any reference herein to coupling, connecting, engaging, fitting, or the like, for example, through interference fits, snap-fits, screw fits/threads, may also or instead include any of the other means for connection discussed herein or otherwise known in the art. For example, these connections may also or instead include, without limitation, clamps, clips, friction fits, hooks, latches, pins, sliders, and so forth. In other words, a skilled artisan will understand that the components of the devices, systems, kits, and methods described herein may be connected and assembled through numerous means known in the art.

The stored energy mechanism may be in the form of a mechanical spring 104, for example, as shown in FIG. 1. The spring 104 may be biased between the moving seal 108 and the distal cap 102 thereby applying a force to the moving seal 108. The stored energy mechanism may also or instead include a compressible fluid pressurized to apply the force to the moving seal 108. In general, the stored energy mechanism may be configured to pressurize an interior of the fluid reservoir 106 by applying a force to the moving seal 108. As discussed above, in one aspect, the stored energy mechanism is a pre-loaded spring 104 with a spring constant of about 1.73 N/mm to provide enough force to push about 1.5 cc of water through a 22G needle (or the like) into a 3 cc syringe (or the like) in about 4.4 seconds. For example, a spring from McMaster-Carr (Product #9657K312) may be used. The spring 104 may have an outer diameter smaller than the inner diameter of the fluid reservoir 106. In another aspect not shown in FIG. 1, the stored energy mechanism may include a pressurized gas (e.g., air) within the pressure chamber.

The fluid reservoir 106 may include an opening 124 on a top portion thereof for receiving a needle 126, and an orifice 125 on a bottom portion thereof for receiving the stored energy mechanism and moving seal 108. The fluid reservoir 106 may be sized to contain an amount of fluid to reconstitute a single dose of the pharmaceutical in a chamber 122 included within the fluid reservoir 106. The fluid in the fluid reservoir 106 may include a liquid diluent. For example, the fluid in the fluid reservoir 106 may include a bacteriostatic solvent (e.g., bacteriostatic water). Thus, in one aspect, the fluid reservoir 106 may be a water chamber where bacteriostatic water is contained within the chamber 122 of the fluid reservoir 106. The fluid reservoir 106 may also house the moving seal 108. The fluid reservoir 106 may be made from any material known in the art, including, without limitation, glass, plastic, metal, rubber, and so on. For example, the fluid reservoir 106 may be made from neoprene to take advantage of its inherent airtight and waterproof characteristics, or the fluid reservoir may be made from the same material as a standard syringe. In fact, in one aspect, the fluid reservoir 106 is the barrel of a standard syringe that is adapted for the purposes of the device 100. In one aspect, the diameter of the fluid reservoir 106 is similar to its height since elongated or flat configuration of the fluid reservoir 106 can significantly compromise the overall shape of the device 100. The fluid reservoir 106 may have a diameter of about 0.44 inches to hold about 1.5 cc of fluid of the same height (e.g., water). In one aspect, a 10 cc syringe may be used as the fluid reservoir 106, which has an inner diameter of about 0.65 inches. In general, the fluid reservoir 106 may be any container that has leak-free fluid storage capacity. The fluid reservoir 106 may automatically empty its contents into the syringe 118 when reconstitution is actuated, which eliminates drug preparation by a user. The minimum height of the fluid reservoir 106 may be dictated by the sum of the compressed spring 104 length, the moving seal 108 thickness, and the distance from the opening 124 to the desired volume of the fluid (i.e., height of the desired volume of the fluid inside the fluid reservoir 106). By way of example, based on the measurements of these dimensions, in an implantation using a syringe for the fluid reservoir 106, the syringe may be cut about 1.54 inches away from the tip of the Luer lock system to create the fluid reservoir 106.

The moving seal 108 may be located within the fluid reservoir 106 forming a barrier between the chamber 122 of the fluid reservoir 106 and the stored energy mechanism. The moving seal 108 may form a fluid seal within the fluid reservoir 106 in the same manner as the plunger of a syringe using any suitable shape and material suitable for sealing fluid such as a diluent within the fluid reservoir 106 under conditions (e.g., pressures) contemplated herein. Thus, in one aspect, the moving seal 108 may include a plunger sized to slide within an interior of the fluid reservoir 106 while maintaining a fluid seal to retain a fluid within the interior of the fluid reservoir 106. The bottom side of the moving seal 108 may be connected to the spring 104 so that the spring 104 is compressed when the chamber 122 of the fluid reservoir 106 is filled with fluid in the pre-reconstitution stage (see FIG. 3, discussed below) while the extension of the spring 104 during reconstitution will push the moving seal 108 towards the top of the fluid reservoir 106 and push the fluid out into the syringe 118 (see FIG. 4, discussed below). In another aspect not shown in FIG. 1, the moving seal may include a membrane such as an elastic membrane or an inelastic membrane within a pressurized chamber as described in various embodiments below.

The fluid reservoir seal 110 may be a seal forming a pierceable, self-sealing cover for the opening 124 of the fluid reservoir 106. In one aspect, the fluid reservoir seal 110 is coupled to the needle 126 of the syringe 118. In another aspect, the fluid reservoir seal 110 is engaged with the opening 124 of the fluid reservoir 106. For example, the fluid reservoir seal 110 may be integral with the fluid reservoir 106. The fluid reservoir seal 110 may seal the opening 124 of the fluid reservoir 106 at or above a pressure created by the force applied to the fluid by the stored energy mechanism. The fluid reservoir seal 110 may be formed from a low-durometer rubber, which may include, without limitation, one or more of neoprene and polyisoprene. The fluid reservoir seal 110 may utilize a Luer lock system or the like to achieve a complete seal of the fluid reservoir 106. For example, since a length of a Luer lock may be large enough to completely sheath a long needle aperture, a rubber seal as thick as the Luer lock system may be used to separate the needle 126 from the chamber 122 before reconstitution. Specifically, about a 0.17-inch thick neoprene piece may be inserted into a female Luer lock fitting of a syringe having its needle portion removed. In one aspect, a ventilated female Luer lock cap may be used (e.g., a female Luer lock fitting without the needle). This may be a commercially available female Luer lock fitting. In order to ensure that the fluid reservoir seal 110 does not get displaced while the syringe 118 and the needle 126 are pushed in by a user, an interference fit may be used. For example, the diameter of the fluid reservoir seal 110 may be at least about 0.004 inches larger than about a 0.14-inch inner diameter of the female fitting. Although a larger diameter of the fluid reservoir seal 110 results in a higher friction with the interior wall of the female fitting and might be desirable for a more robust placement of the seal, this dimension should not be infinitely expanded because fracture may occur (e.g., neoprene can fracture). The fluid reservoir seal 110 may also or instead include a membrane that acts as a barrier for the chamber 122.

The first shaft 112 may be a chamber shaft that generally houses the fluid reservoir 106. The first shaft 112 may include a distal portion 128 configured to engage the distal cap 102 and a proximal portion 130 configured to engage the second shaft 114. The first shaft 112 may be part of an alignment fixture for the device 100. The first shaft 112 may be designed such that it can house the fluid reservoir 106, which may include a modified 10 cc syringe or the like. For an easy insertion of the fluid reservoir 106 into the first shaft 112 during manufacturing, a clearance fit may be employed. For example, the inner diameter of the first shaft 112 may be about 0.66 inches, which is about 0.01 inches larger than the outer diameter of a 10 cc syringe.

The first shaft 112 may include a length determined by summing the dimensions of the fluid reservoir 106, spring 104, internal flange (see FIG. 3), and needle 126, all of which may be fully confined inside the first shaft 112. The first shaft 112 may include an exterior thread at a proximal portion 130 for a self-locking interaction with the second shaft 114. As described above, other connections are possible. On the distal portion 128, the same thread design and pitch may be used to interact with the distal cap 102. By placing the distal cap 102 on the first shaft 112, the spring 104 may be fully compressed and the entire system may be closed from the outside, completing the assembly of the device 100. While the first shaft 112 adds length to the overall device 100, it can be disconnected (e.g., unscrewed) and shed upon injection to leave a device nearly identical in size to a standard syringe.

The second shaft 114 may be a syringe shaft that generally houses the syringe 118. The second shaft 114 may include a distal region 132 configured to engage the first shaft 112 and a proximal region 134 configured to engage the proximal cap 116. Similar to the first shaft 112 discussed above, the second shaft 114 may also or instead be part of an alignment fixture for the device 100. The second shaft 114 may serve as a container for the syringe 118 as well as a handle for a user during reconstitution and injection. A clearance fit may be employed between the syringe 118 and the second shaft 114 permitting the syringe 118 to travel axially within the interior of the second shaft 114. To achieve this clearance fit, a hole in the approximate center of the second shaft 114 may have a diameter that is larger (e.g., about 0.01 inches larger) than an outer diameter of the syringe 118. In this manner, there may be a loose interference fit between the outer diameter of the body of the syringe 118 and the inner diameter of the second shaft 114—it can be slid in and out, where there are features on the inside of the second shaft 114 that match with features on the outside of the syringe 118 to retain the syringe 118 in place. The length of the second shaft 114 may match the distance from the end of the Luer lock to the top of the flange 150 of the syringe 118 in order to expose the plunger 140 out of the proximal region 134 and the needle 126 (which may be pre-attached to the syringe 118) out of the distal region 132 while the user operates the device 100 for an injection.

The second shaft 114 may also include features on both ends to allow its interaction with the proximal cap 116 and the first shaft 112. The second shaft 114 may include a circular support 142 that exceeds the length of the syringe flange 150 on the proximal region 134 of the second shaft 114 to serve as a barrier to prevent the syringe 118 from being pushed too far into the second shaft 114 while the user for initial reconstitution and subsequent self-injection is depressing the plunger 140. On the top surface of this projection, there may exist a hollow cylinder that functions as a spacer 144 for an exact syringe displacement. When the syringe 118 initially rests at the top end of the spacer 144, the tip aperture of the needle 126 may remain inside the fluid reservoir seal 110, which prevents any premature mixing. However, when a user presses the plunger 140 or flange 150 to the point where the flange 150 of the syringe 118 meets the top surface of the circular support 142, the needle 126 may travel a sufficient distance past the fluid reservoir seal 110 into the fluid reservoir 106 to initiate the reconstitution. If 22G, ¾ inch needles are used for the device 100, the length of the needle aperture may be about 0.115 inches. To ensure that the aperture is fully submerged into the fluid reservoir 106 past the fluid reservoir seal 110 (which may include about a 0.17 inch-thick rubber seal), a safety factor of two may be used for the aperture length, which consequently sets the height of the spacer 144 to about 0.23 inches. Inside the spacer 144, there may be two curved walls that flank the flange 150 of the syringe 118 and fix its position while it is being pressed into the second shaft 114 by the user. The second shaft 114 may also include a thread or the like added to the outer surface of the spacer 144 to realize a self-locking interaction with the proximal cap 116. The dimensions of the features of the second shaft 114 disposed at the distal region 132 may be dictated by the size of the first shaft 112 and the fluid reservoir 106. For example, to provide enough space for insertion of the first shaft 112, a platform 148 with a hole larger than the outer diameter of the first shaft 112 may be used (e.g., about 0.76 inches in an implementation).

The proximal cap 116 may generally include a cap for the proximal end 136 of the device 100. The proximal cap 116 may provide a barrier to prevent the user from accidentally pulling the syringe 118 out of the second shaft 114. The proximal cap 116 may include a threading or the like to engage with the thread on the outer surface of the spacer 144. As described above, other connections are possible. The proximal cap 116 may also include an opening 146 that resembles the general shape of the flange 150 of the syringe 118 but with slightly larger dimensions. In one aspect, when the proximal cap 116 is not in the locked position, it can be rotated to align an opening 146 with the syringe flange 150, allowing an easy insertion of the syringe 118 during a manufacturing or other assembly process. In one aspect, however, when the proximal cap 116 is fully locked, a large portion of the syringe flange 150 may be covered, preventing undesired removal of the syringe 118 from the second shaft 114 when the user operates the device 100. In another aspect, the proximal cap 146 may include features to retain the syringe 118 in a fixed pre-reconstituted state for additional safety. In this embodiment (not shown), the user may remove a safety tab or the like preventing premature or accidental reconstitution from occurring before initiating reconstitution (e.g., by depressing the plunger 140).

The syringe 118 may include a barrel 138, a plunger 140, and the needle 126. The syringe 118 may be the injection mechanism for the device 100. The syringe 118 may include a standard approved 3 mL disposable over-the-counter (OTC) syringe. For example, the syringe 118 may include a commercially available syringe such a 3 mL VitaNeedle (Part #SY707) or BD Luer-Lok (Part #309657) syringe. A skilled artisan will recognize that other sizes and designs of syringes may be used in the devices, systems, kits, and methods described herein. A force required to interact with the syringe 118 may be the same or similar to that of an OTC syringe. The syringe 118 may include a single fixed dose of a pharmaceutical so that, once reconstituted, the syringe 118 may be used to manually inject the reconstituted pharmaceutical into a patient. Alternatively, the syringe 118 may include multiple doses, which may require refrigeration. In another aspect, the syringe 118 may include an automatic injector.

Figure 2:
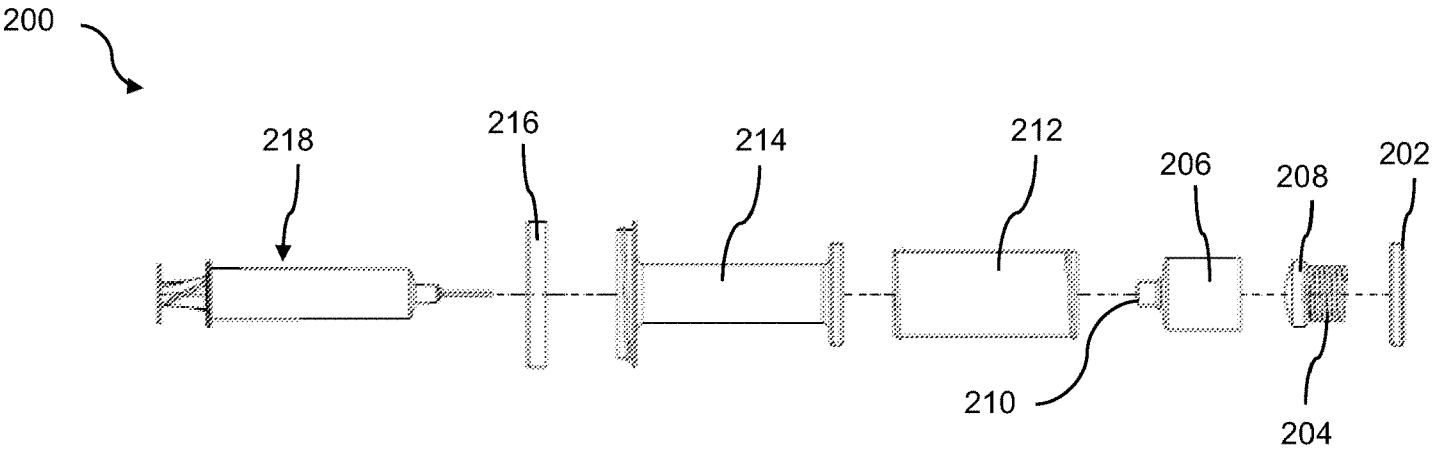
FIG. 2 is an exploded side view of a device with a moving seal.

FIG. 2 is an exploded side view of a device with a moving seal. The device 200 may include a distal cap 202, a spring 204, a fluid reservoir 206, a moving seal 208, a fluid reservoir seal 210, a first shaft 212, a second shaft 214, a proximal cap 216, and a syringe 218.

Figure 3:
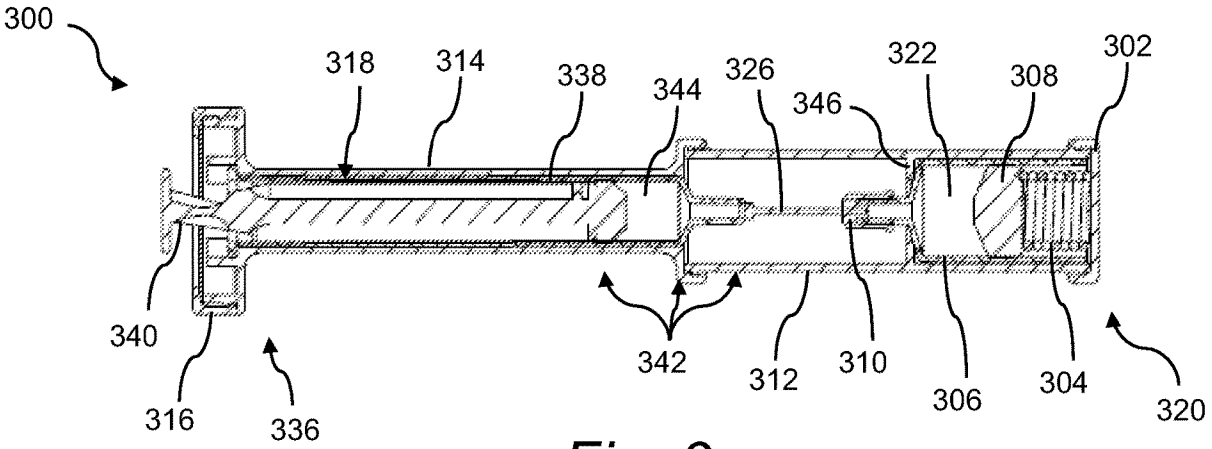
FIG. 3 is a cross-sectional view of a device prior to reconstitution.

FIG. 3 is a cross-sectional view of a device 300 prior to reconstitution. The device 300 may include a distal cap 302, a spring 304, a fluid reservoir 306, a moving seal 308, a fluid reservoir seal 310, a first shaft 312, a second shaft 314, a proximal cap 316, and a syringe 318.

Assembly of the device 300 as shown in FIG. 3 will now be described. In one aspect, the fluid reservoir 306 may be filled with a fluid, which may be pressurized, e.g., by the stored energy mechanism. To assemble this portion of the device 300, a diluent selected for reconstituting a pharmaceutical may be disposed into the fluid reservoir 306. For example, to provide a substantially air-free source of diluent, the fluid reservoir seal 310 may be placed to seal an end of the fluid reservoir 306, and then the fluid reservoir may be filled with a diluent through the opposing, open end. The opposite end may then be sealed with the moving seal 308, and the spring 304 may be manually compressed and then the distal cap 302 may be threaded onto or otherwise attached to the fluid reservoir 306. In one aspect, after filling the fluid reservoir 306 with a fluid and inserting the moving seal 308, the fluid reservoir seal 310 is removed and the moving seal 308 is moved axially until the air is pushed out of the fluid reservoir 306. Then, the fluid reservoir 306 is re-capped with the fluid reservoir seal 310. In another aspect, the moving seal 308 may be placed in the fluid reservoir 306 and the spring 304 compressed to evacuate air from the fluid reservoir 306 before the fluid reservoir seal 310 is attached. Then the fluid reservoir seal 310 may be attached and a needle or the like may be used to pierce the seal 310 and drive fluid under pressure into the fluid reservoir 306. This may compress the spring 304 any desired amount to provide a fluid reservoir 306 filled with a pressurized fluid.

However assembled, the assembly of the fluid reservoir 306 (with the fluid reservoir seal 310 and the moving seal 308) may then be placed inside of the first shaft 312. Once the fluid reservoir 306 is in place, a sterile syringe 318 (and needle 326) containing an appropriate amount of a pharmaceutical may be placed within the proximal end 336 of the device 300 and the first shaft 312 and the second shaft 314 may be coupled using any suitable mechanical coupling system. For example, the first shaft 312 and the second shaft 314 may be screwed together, snapped together (e.g., with a flanged rim), coupled with an interference fit, and so forth.

The syringe 318 may be placed inside of the second shaft 314. The proximal cap 316 may then be fitted to the proximal end 336 of the device 300 (e.g., screwed onto the second shaft 314). The second shaft 314 may then be fitted to the first shaft 312 (e.g., screwed onto the first shaft 312). In another aspect, the syringe 318 may be axially inserted into the second shaft 314, and the proximal cap 316 may include slots or other openings to receive the flange of the syringe 318, which may then be axially rotated so that a flanged surface of the proximal cap 316 retains the flanges of the syringe 318 to secure the syringe 318 against axial displacement within the second shaft 314. More generally, any technique for securely positioning the syringe 318 in a predetermined position and orientation relative to the fluid reservoir 306 may be employed, including any of a variety of mechanisms to removable and replaceably secure the syringe 318 in a desired alignment with the plunger 340 accessible.

In a manufacturing process, this assembly may be aided by automated filling equipment, e.g., in order to ensure accurate filling of the fluid and the purging of all air. Additionally, instead of screw caps, snap features can be designed to be injection molded and may streamline any manual assembly of the device 300. Placing all of these components together may place the device 300 in a "ready" state, where the device 300 is ready for reconstituting a pharmaceutical contained in the interior 344 of the syringe 318. In this "ready" state, the fluid reservoir 306 is filled with a pressurized diluent within the chamber, and the syringe 318 is evacuated except for a pharmaceutical or the like for reconstitution. The needle 326 is positioned with a tip partially but not entirely breaching the fluid reservoir seal 310, so that the seal 310 retains the pressurized fluid within the chamber 322 and retains the pharmaceutical within the syringe 318 (with the plunger enclosing the other open end of the barrel of the syringe 318.

As shown in FIG. 3, either or both of the first shaft 312 and the second shaft 314 may form an alignment fixture 342 that aids in the alignment of the syringe 318 with the fluid reservoir 306. Alternatively, the alignment fixture may be another component of the device that aids in the alignment of the syringe 318 with the fluid reservoir 306. The alignment fixture 342 may be coupled to the fluid reservoir 306, where the alignment fixture 342 is shaped and sized to retain the needle 326 and syringe 318, which may have predetermined dimensions, in a position and orientation with the needle 326 breaching the fluid reservoir seal 310 to couple an interior 344 of the syringe 318 in fluid communication with the chamber 322 of the fluid reservoir 306.

Alternatively, the alignment fixture 342 may be coupled to the fluid reservoir 306 and sized and shaped to retain the needle 326 and syringe 318 in a position and orientation with the needle 326 partially breaching the fluid reservoir seal 310 to form a barrier between the chamber 322 (i.e., interior of the fluid reservoir 306) and the interior 344 of the syringe 318 to concurrently and separately retain a fluid in the chamber 322 and a pharmaceutical in the interior 344 of the syringe 318. The syringe 318 may further include a plunger 340 to enclose the pharmaceutical in the interior 344 of the syringe 318. The plunger 340 and the fluid reservoir seal 310 may isolate the pharmaceutical from environmental conditions. The alignment fixture 342 may accommodate an axial movement of the syringe 318 to pierce the fluid reservoir seal 310 with the needle 326 and couple the chamber 322 in fluid communication with the interior 344 of the syringe 318.

The alignment fixture 342 may include one or more mechanical alignment features to engage the syringe 318 against axial displacement. The one or more mechanical alignment features may include one or more tabs or the like, which may be included on the second shaft 314 to rotatably engage the syringe 318 against axial displacement within the alignment fixture 342. The tabs or the like may also or instead be included on the first shaft 312. The one or more mechanical alignment features may also or instead include the curved walls described above with reference to FIG. 1. The alignment fixture 342 may removably and replaceably engage the syringe 318 to facilitate withdrawal of the needle 326 and syringe 318 from the alignment fixture 342. For example, the alignment fixture 342 may engage the syringe 318 and the fluid reservoir 306 with a clearance fit or an interference fit. The alignment fixture 342 and/or the first shaft 312 may be removably and replaceably coupled to the fluid reservoir 306 to permit detachment of the alignment fixture 342, the first shaft 312, the syringe 318, and the needle 326 from the fluid reservoir 306 for use in an injection. In another aspect, the alignment fixture 342 is not detached from the fluid reservoir 306 as a whole—rather the first shaft 312, the syringe 318, and the needle 326 are detached from the fluid reservoir 306 for injection.

As stated above, the interaction between the first shaft 312 and the fluid reservoir 306 may be a clearance fit. Because a clearance fit does not provide a frictional force that can counteract the spring force that the fluid reservoir seal 310 and fluid reservoir 306 experience during the pre-reconstitution stage, and the fluid reservoir 306 should stay at a fixed position before the user initiates the device operation to prevent any premature drug reconstitution, an additional feature may be built on the interior wall of the first shaft 312 to serve as a hard stop for the fluid reservoir 306. This feature may be a concentric, internal flange 346 of a smaller inner diameter to retain the fluid reservoir 306 in a desired axial position within the first shaft 312.

Prior to reconstitution, the needle 326 of the syringe 318 may be partially inserted into the fluid reservoir seal 310 such that the needle is not coupled to the interior of the chamber 322. The proximal cap 316 may be shaped to accommodate a slight axial displacement of the syringe so that a user can push the plunger 340 (or other portion of the syringe 318) and drive the needle 326 through the seal 310 to couple the interior 344 of the syringe 318 in fluid communication with the chamber 322 of the fluid reservoir 306. In another aspect, the needle 326 of the syringe 318 may be fully inserted into the fluid reservoir seal 310 such that the needle coupled the syringe 318 in fluid communication with the chamber 322, but without a diluent added to the chamber 322 or the spring 304 (or other stored energy mechanism) actuated to force the diluent from the chamber 322 into the syringe 318. In this latter embodiment, the cap 302 with the moving seal 308 may be placed to enclose a pharmaceutical or the like in the syringe 318 against environmental conditions during storage or transportation.

Figure 4:
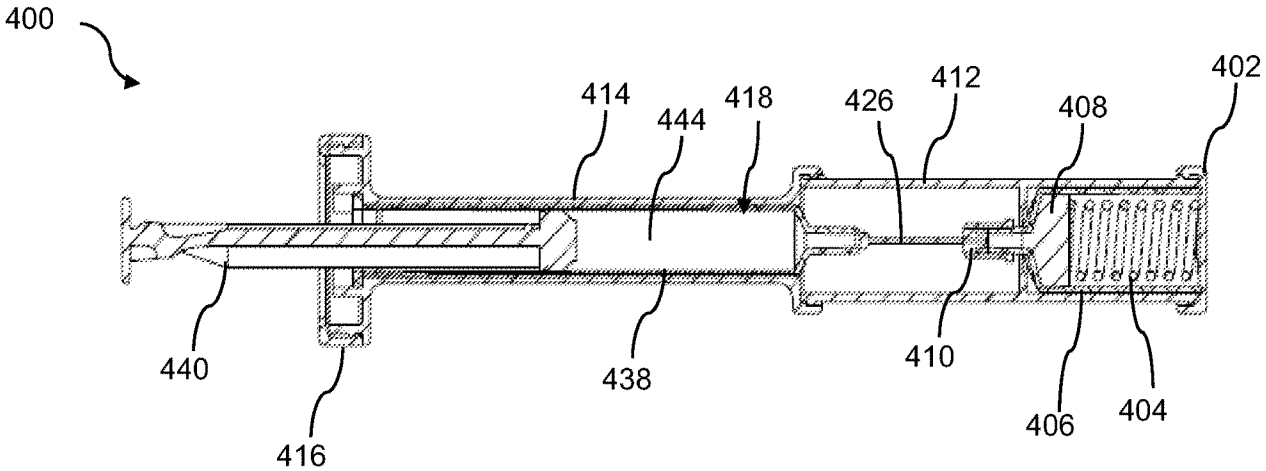
FIG. 4 is a cross-sectional view of a device after reconstitution.

FIG. 4 is a cross-sectional view of a device 400 after reconstitution. The device 400 may include a distal cap 402, a spring 404, a fluid reservoir 406, a moving seal 408, a fluid reservoir seal 410, a first shaft 412, a second shaft 414, a proximal cap 416, and a syringe 418. The device 400 may also include a reconstituted pharmaceutical or the like contained within interior 444 of the syringe 418.

In order to place the device 400 in its reconstituted state (FIG. 4) from its "ready" state (FIG. 3), the device 400 may be actuated. Actuation of the device 400 may occur through a number of means. For example, a user may push the syringe 418 (e.g., the plunger 440 or the flange of the syringe 418) with an axial force (e.g., into the second shaft 414), which axially moves the syringe 418 further into the second shaft 414. This movement may concurrently move the needle 426 from a first position partially disposed within the fluid reservoir seal 410 (or adjacent to the fluid reservoir seal 410) to a second position where the needle 426 pierces the fluid reservoir seal 410 such that a tip of the needle 426 is disposed within the fluid reservoir 406. In this manner, in the second position, an aperture of the needle 426 is disposed within the chamber of fluid reservoir 406 placing the interior 444 of the syringe 418 in fluid communication with the chamber. Because the reconstitution fluid within the chamber may be under pressure from the stored energy mechanism (e.g., the spring 404), the fluid then travels through the aperture of the needle 426 into the interior 444 of the syringe 418 thereby reconstituting the pharmaceutical.

Actuation of the device 400 may also or instead occur through applying another force to the plunger 440 of the syringe 418, e.g., pushing the plunger 440 to drive the plunger 440 and syringe 418 toward the seal 410. The device 400 may also or instead be actuated by releasing the spring 404, which may initially drive the entire fluid reservoir 406 toward the syringe 418 so that the needle 426 can pierce the seal 410 and couple the fluid reservoir 406 in fluid communication with the syringe 418 as described above. At the same time, the force provided by the spring 404 may pressurize fluid such as a diluent in the fluid reservoir 406 by applying an axial force to the moving seal 408. Releasing the spring 404 may be done through pressing a button or the like, which may be disposed on the first shaft 412 or the distal cap 402. Releasing the spring 404 may also or instead occur by turning the distal cap 402. Actuation of the device 400 may also or instead occur through attaching the first shaft 412 to the second shaft 414. A skilled artisan will recognize that other means of actuation are also possible.

More generally, "actuation" may couple the diluent in the pressurized fluid reservoir 406 with the interior 444 of the syringe 418 (and a pharmaceutical contained within the interior 444 of the syringe 418). As a result, the diluent from the pressurized vessel infiltrates the syringe 418, driving the plunger 440 out of the barrel of the syringe 418 and mixing the diluent with the pharmaceutical or other composition in the barrel. After the diluent has evacuated the fluid reservoir 406, e.g., when the moving seal 408 reaches a limit of axial travel, the syringe 418 with a reconstituted composition may be ready for use.

In this reconstituted state as shown in FIG. 4, the pharmaceutical contained in the syringe 418 has been reconstituted and is ready for injecting into a patient. In this reconstituted state, the moving seal 408 may have been moved toward the end of the chamber thereby forcing the reconstituting fluid in the chamber into the syringe 418 and reconstituting the pharmaceutical. Also, in the reconstituted state, the plunger 440 may be retracted from the barrel 438 of the syringe 418. To administer the pharmaceutical to a patient, the syringe 418 can be removed from the device 400, e.g., by rotating the flanges of the syringe 418 and axially withdrawing the syringe 418 from the second shaft 414, or by detaching the first shaft 412 from the second shaft 414. Additionally or alternatively, removing the syringe 418 may be accomplished by removing the proximal cap 416, which may be threaded onto or otherwise coupled to the second shaft 414.

Figure 5:
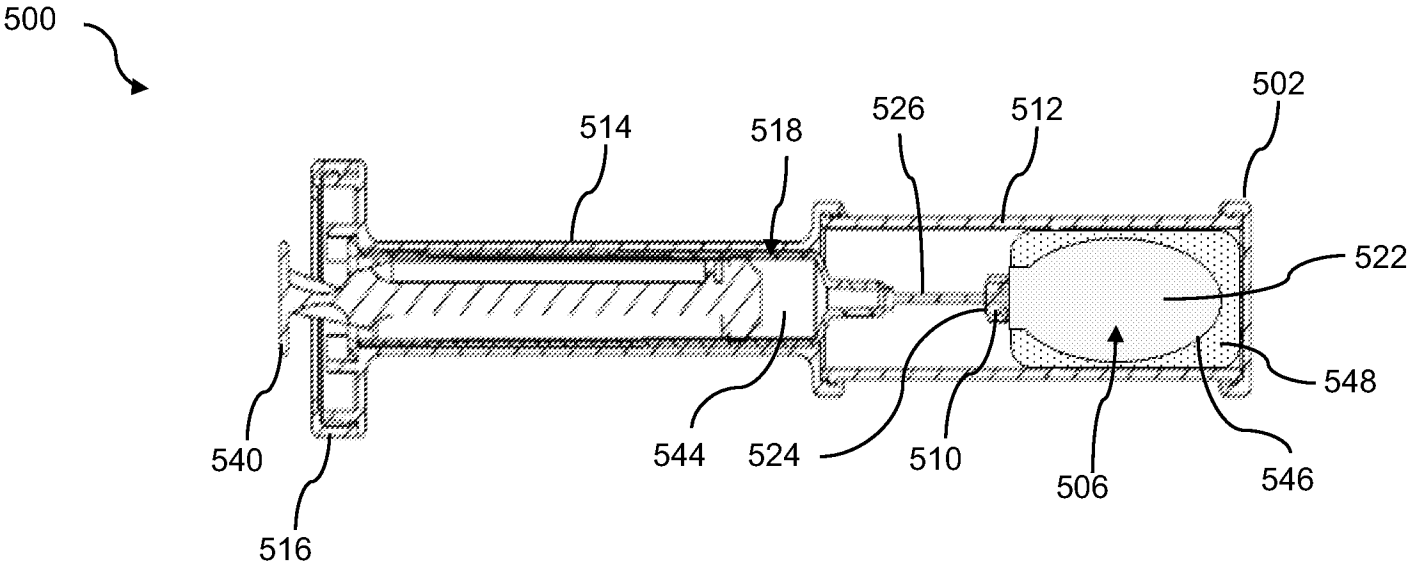
FIG. 5 is a cross-sectional view of a device with an elastic fluid reservoir.

FIG. 5 is a cross-sectional view of a device 500 with an elastic fluid reservoir 506. The device 500 may include a distal cap 502, an elastic fluid reservoir 506, a fluid reservoir seal 510, a first shaft 512, a second shaft 514, a proximal cap 516, and a syringe 518. In general, the membrane 546 may replace the moving seal described above, and may contain a diluent within the chamber 522 for pressurized delivery to the syringe 514. The membrane 546 may be surrounded by a pressurized (or pressurizable) fluid in a pressurizing chamber which may be pressurized in any suitable manner to correspondingly pressurize the chamber 506. In another aspect, the membrane 546 may be an elastic membrane that may also or instead pressurize the diluent in the chamber 506 for delivery to the syringe 518 when the seal 510 is breached by the needle 526.

The fluid reservoir 506 may include a membrane 546. The membrane 546 may be an elastic membrane such as a balloon or the like configured to pressurize an incompressible fluid such as a diluent within the fluid reservoir 506. The membrane 546 may also or instead be externally pressurized from a pressurizing chamber 548. The fluid reservoir 506 may include an opening 524 that is sealed with the fluid reservoir seal 510. The fluid reservoir 506 may be capable of changing an interior volume either through elastic contraction or other deformation. In this manner, the membrane 546 provides a moving seal performing a similar function to the moving seals described above, except that the moving seal is provided by a deformable membrane barrier about a diluent rather than a rigid seal axially moving within a reservoir.

The pressurizing chamber 548 may include a stored energy mechanism outside of the membrane 546 that applies a pressure to the membrane 546. The stored energy mechanism may include a pressurized gas within the pressurizing chamber 548. The pressurized gas may include air. In one aspect, the pressurizing chamber 548 may form a rigid shape around the fluid reservoir 506, or a flexible bag around the fluid reservoir 506.

Similar to devices described above, the device 500 may include a needle 526 and a syringe 518, where the syringe 518 has an interior 544 containing a pharmaceutical. The elastic fluid reservoir seal 510 may include a pierceable, self-sealing cover to seal the opening 524 against passage of the fluid at or above a pressure applied by the membrane 546. The needle 526 may be positioned to partially breach the elastic fluid reservoir seal 510 to form a barrier between the chamber 522 (i.e., the interior of the elastic fluid reservoir 506) and an interior 544 of the syringe 518 to concurrently and separately retain the fluid in the elastic fluid reservoir 506 and the pharmaceutical in the syringe 518. The needle 526 may be oriented to fully pierce the elastic fluid reservoir seal 510 by an application of axial force to the syringe 518 (e.g., the plunger 540 of the syringe 518), thereby coupling the chamber 522 in fluid communication with the interior 544 of the syringe 518 and permitting the fluid to pass from the elastic fluid reservoir 506 to the syringe 518.

Figure 6:
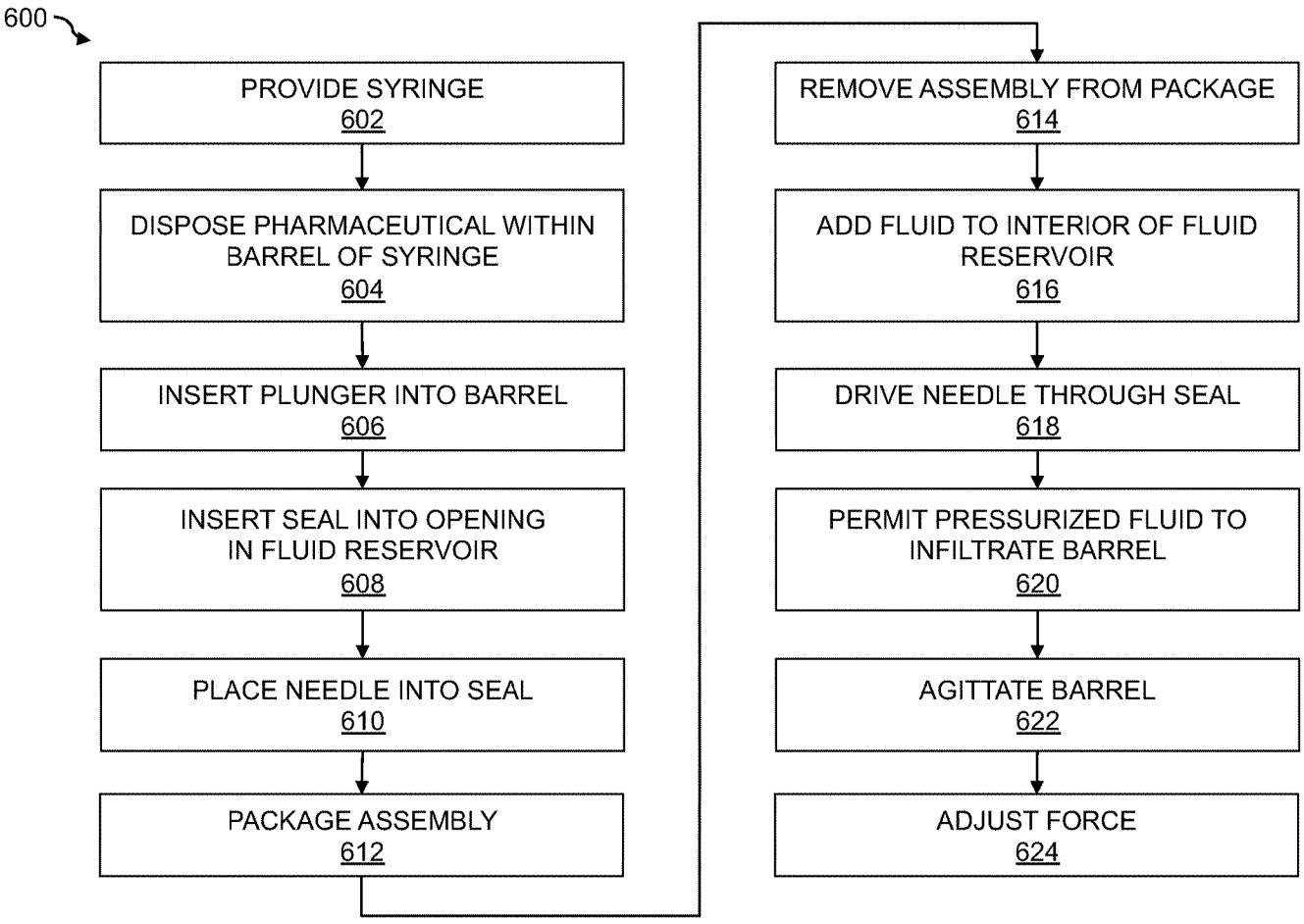
FIG. 6 is a method of manufacturing/packaging a device.

FIG. 6 shows a method 600 of manufacturing/packaging a device. In general, the method 600 may include preloading of a pharmaceutical and packaging for distribution. Thus, the method 600 might be practiced by a manufacturer. The steps of the method 600 described below, or any method described herein, may be performed by an individual, a group of individuals, a machine, a series of machines, or any combination thereof.

As shown in step 602, the method 600 may include providing a syringe, for example, providing a syringe having a barrel and a needle. The syringe may be an off-the-shelf syringe, or a custom-made syringe for a device for reconstituting a pharmaceutical. The syringe may be of predetermined dimensions.

As shown in step 604, the method 600 may include disposing a pharmaceutical within the barrel of the syringe, i.e., an interior of the barrel of the syringe. The pharmaceutical may be any pharmaceutical composition described herein, and may include a lyophilized pharmaceutical. Disposing the pharmaceutical within the interior of the barrel may include lyophilizing the pharmaceutical into the barrel of the syringe. For example, in a manufacturing setting, the pharmaceutical may be lyophilized in-situ within the syringe. Disposing the pharmaceutical within the barrel of the syringe may also or instead include dehydrating a pharmaceutical inside the barrel, depositing a powder or other reconstitutable form of the pharmaceutical in the barrel, or any other suitable technique.

As shown in step 606, the method 600 may include inserting a plunger into the barrel of the syringe, e.g., to retain the pharmaceutical within the barrel on a first end of the syringe.

As shown in step 608, the method 600 may include inserting a seal into an opening in a fluid reservoir. It will be appreciated that this step may be readily performed either before or after the needle is inserted into the seal as described in step 610.

As shown in step 610, the method 600 may include placing the needle into the seal. As described herein, the needle may be positioned to partially pass through the seal so that the pharmaceutical can be retained within the barrel, which is sealed on one end by the seal and on the opposing end by the plunger. This may, depending on the tenacity of the opposing seals, isolate the pharmaceutical from environmental conditions such as humidity or non-sterile contaminants. In one aspect, the syringe may be sealed in a vacuum environment to improve the quality of the seal and further protect the pharmaceutical. In another aspect, an inert gas or the like may be used that will not interact with the pharmaceutical during storage or transportation.

The completion of this step 610 may provide an assembly that encapsulates the pharmaceutical in a form ready for use with a diluent. The needle may be inserted partially into the seal, where the assembly will then be in a "ready" position for reconstituting the pharmaceutical. The needle may be axially movable to fully penetrate the seal so that, when coupled to a pressurized fluid reservoir, the syringe can be manipulated to couple its interior with the fluid reservoir and actuate a reconstitution of the pharmaceutical.

As shown in step 612, the method 600 may include packaging the assembly, e.g., in a package for disposable single use. The assembly may thus be designed for disposable single use, where it may be completely disposable after a single use. Alternatively, the assembly may be partially disposable, where some components may be reused after an injection or mixing operation. Alternatively, the assembly may be designed for non-disposable use. Thus, the packaging may also be designed for multiple uses.

A variety of additional steps may be included in the method 600 of FIG. 6. For example, the method 600 described above may include adding a diluent to an interior of the fluid reservoir and pressurizing the fluid, which may occur at any suitable time. In one aspect, this may occur during assembly of the device, e.g., prior to packaging, where this may more specifically occur either before the seal is attached to the needle or after the seal is attached to the needle. In another aspect, this may occur after packaging, such as during use by a patient.

The method 600 may also include use of the assembly as explained in the steps included below.

As shown in step 614, the method 600 may include removing the assembly from the package.

As shown in step 616, the method 600 may include adding a fluid to an interior of the fluid reservoir. This may include pressurizing the fluid in the fluid reservoir, thereby providing a pressurized fluid. The pressurization may be accomplished through the addition of a stored energy mechanism such as attaching a cap with spring and a moving seal, or pressurizing a chamber around a membrane containing a diluent so that the walls of the fluid reservoir apply a pressure on the fluid and seal.

As shown in step 618, the method 600 may include driving the needle through the seal into the fluid reservoir to couple the interior of the fluid reservoir in fluid communication with the interior of the barrel.

As shown in step 620, the method 600 may include permitting the pressurized fluid to infiltrate the barrel thereby reconstituting the pharmaceutical and driving the plunger out of the barrel into a ready position for use in injection.

While the mixing that occurs during infiltration may be sufficient to fully reconstitute the pharmaceutical, as shown in step 622 the method 600 may also optionally include agitating the barrel to mix the fluid and the pharmaceutical.

In another aspect, as shown in step 624, the method 600 may include adjusting a force applied by a stored energy mechanism (e.g., a spring and moving seal, elastic membrane, or a membrane within a pressurized chamber) to control a rate of mixing while the fluid infiltrates the barrel. That is, the pressure of the pressurized fluid may also or instead be adjusted to control a fluid flow rate and a resulting rate of mixing while the fluid infiltrates the barrel.

In yet another aspect, the method 600 may include retaining the needle through the seal with a tip in the fluid reservoir until the fluid stops filling the barrel. In a properly balanced system, the fluid and the pharmaceutical may thus combine to form a reconstituted pharmaceutical at a concentration suitable for human injection.

Figure 7:
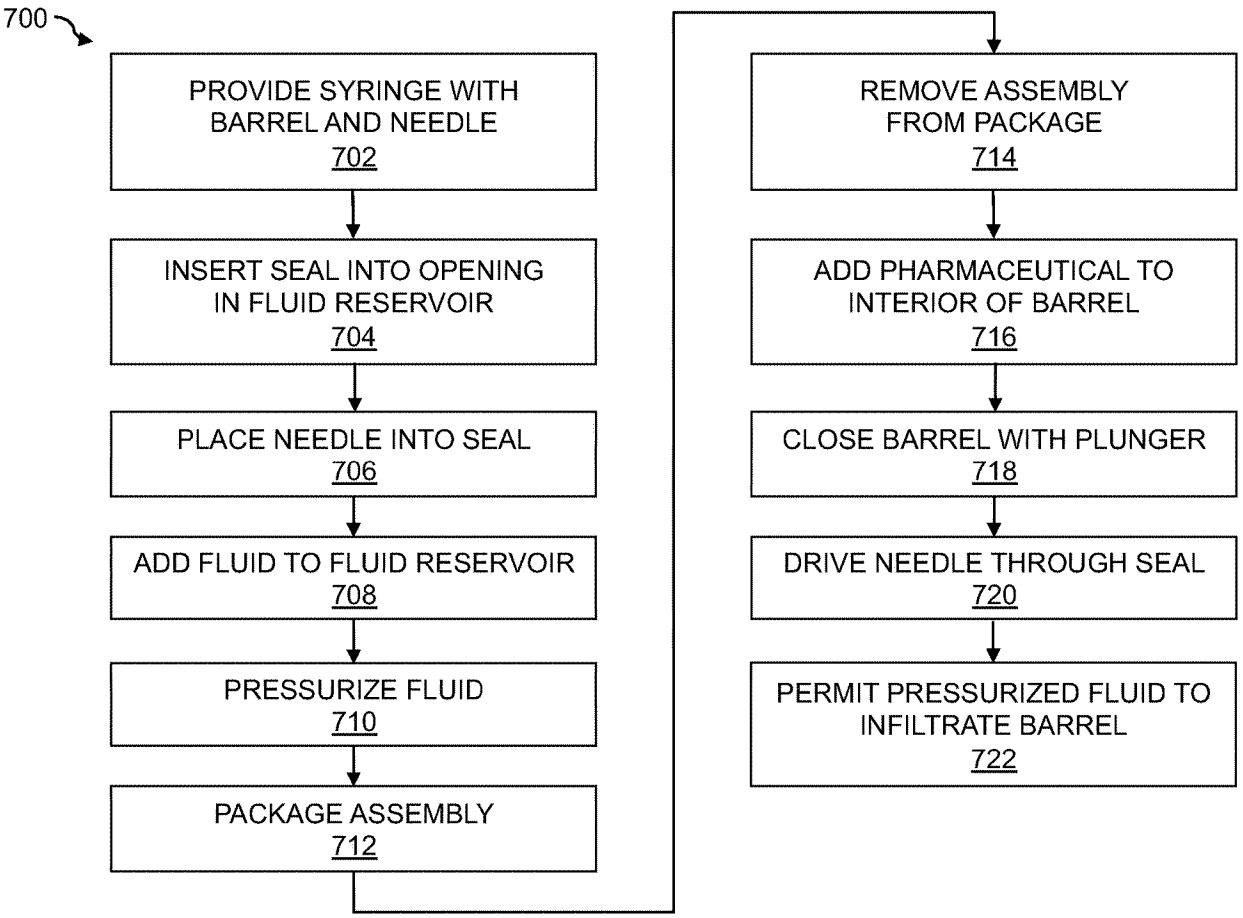
FIG. 7 is a method of manufacturing/packaging a device.

FIG. 7 is a method 700 of manufacturing/packaging a device. In general the method 700 may include steps for packaging a reconstitution fluid for distribution.

As shown in step 702, the method 700 may include providing a syringe having a barrel and a needle.

As shown in step 704, the method 700 may include inserting a seal into an opening in a fluid reservoir in order to seal the opening.

As shown in step 706, the method 700 may include placing the needle into the seal. The needle placement may be at a distance that is sufficient to close a first end of the barrel without the tip of the needle entering the interior of the fluid reservoir. The needle may be coupled to a syringe, plunger, and so forth.

As shown in step 708, the method 700 may include adding a fluid such as a diluent for reconstitution to an interior of the fluid reservoir.

As shown in step 710, the method 700 may include pressurizing the fluid in the fluid reservoir. This may include pressurizing using any of the energy storage mechanisms described above. This step 710 may thus provide an assembly including the syringe, the seal, and the fluid reservoir with a pressurized fluid. While this assembly may be usefully provided as a generic reconstitution instrument, the syringe may optionally also include a pharmaceutical composition such as any of the pharmaceutical compositions described above, which may be secured in a barrel of the syringe by the seal (on the needle end) and a plunger (on the opposing end).

As shown in step 712, the method 700 may include packaging the assembly, e.g., in a package for disposable single use.

The method 700 may also include disposing a pharmaceutical within an interior of the barrel, which may, as noted above, occur before packaging for a fully integrated single use device. This may also occur after the assembly is unpackaged, such as where an end user adds a dry pharmaceutical composition to the barrel of the syringe for reconstitution using the attached pressurized vessel of diluent. The method 700 may further include retaining the pharmaceutical in the barrel with a plunger. The pharmaceutical may include a lyophilized pharmaceutical or any other pharmaceutical composition contemplated herein.

The method 700 may also include use of the assembly as explained in the steps included below.

As shown in step 714, the method 700 may include removing the assembly from the package.

As shown in step 716, the method 700 may include adding a pharmaceutical to an interior of the barrel after removing the assembly from the package.

As shown in step 718, the method 700 may include closing a second end of the barrel with a plunger.

As shown in step 720, the method 700 may include driving the needle through the seal into the fluid reservoir to couple the interior of the fluid reservoir in fluid communication with the interior of the barrel.

As shown in step 722, the method 700 may include permitting the pressurized fluid to infiltrate the barrel thereby reconstituting the pharmaceutical and driving the plunger out of the barrel into a ready position for use in injection.

Figure 8:
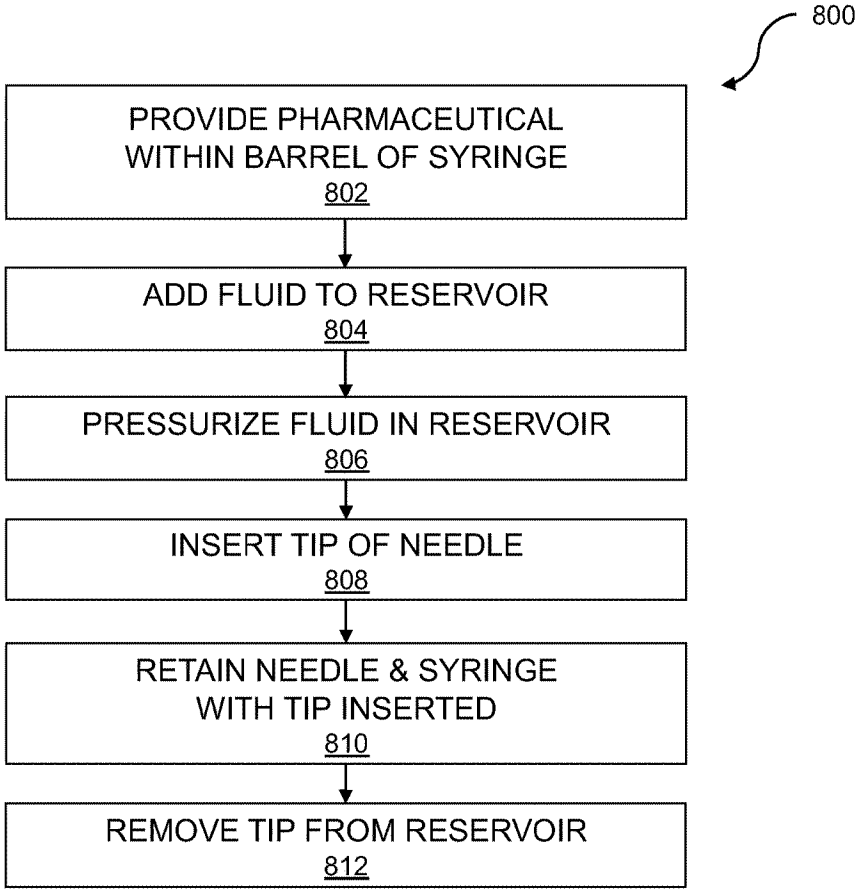
FIG. 8 is a method of using a device.

FIG. 8 is a method 800 of using a device for reconstituting a pharmaceutical. The steps of the method 800 may be performed by a patient, a physician, a nurse, and so on. In an implementation, the device is easy to use, requiring little instruction and training, and thus can be used by an individual without formal medical training.

As shown in step 802, the method 800 may include providing a pharmaceutical in the barrel of a syringe. The pharmaceutical may be any described herein, and may include a lyophilized pharmaceutical. The pharmaceutical may be retained in the barrel of the syringe by a plunger. The syringe may further include a needle.

As shown in step 804, the method 800 may include adding a fluid to a reservoir. The fluid may be any diluent or the like selected to reconstitute the pharmaceutical.

As shown in step 806, the method 800 may include pressurizing the fluid in the reservoir to provide a pressurized reservoir. Pressurization may be provided by any suitable stored energy mechanism such as the various stored energy mechanisms described herein. The reservoir may be pressurized sufficiently so that when a needle of a syringe is driven into the reservoir (i.e., through the seal), the fluid can pass through the needle and into the syringe with a force sufficient to displace a plunger in the syringe.

As shown in step 808, the method 800 may include inserting the tip of the needle into the pressurized reservoir.

As shown in step 810, the method 800 may include retaining the needle and syringe with the tip inserted into the pressurized reservoir while the fluid in the pressurized reservoir drives the plunger away from the needle and fills the barrel. The actual force and pressurization required may depend on the specific needle, syringe, and plunger used. One of ordinary skill in the art can readily determine typical forces and pressures suitable for the applications contemplated here.

As shown in step 812, the method 800 may include removing the tip of the needle from the pressurized reservoir. The fluid within the syringe may reconstitute the pharmaceutical in the syringe during and/or after this filling process, after which the syringe and needle are ready for use in an injection.

Figure 9:
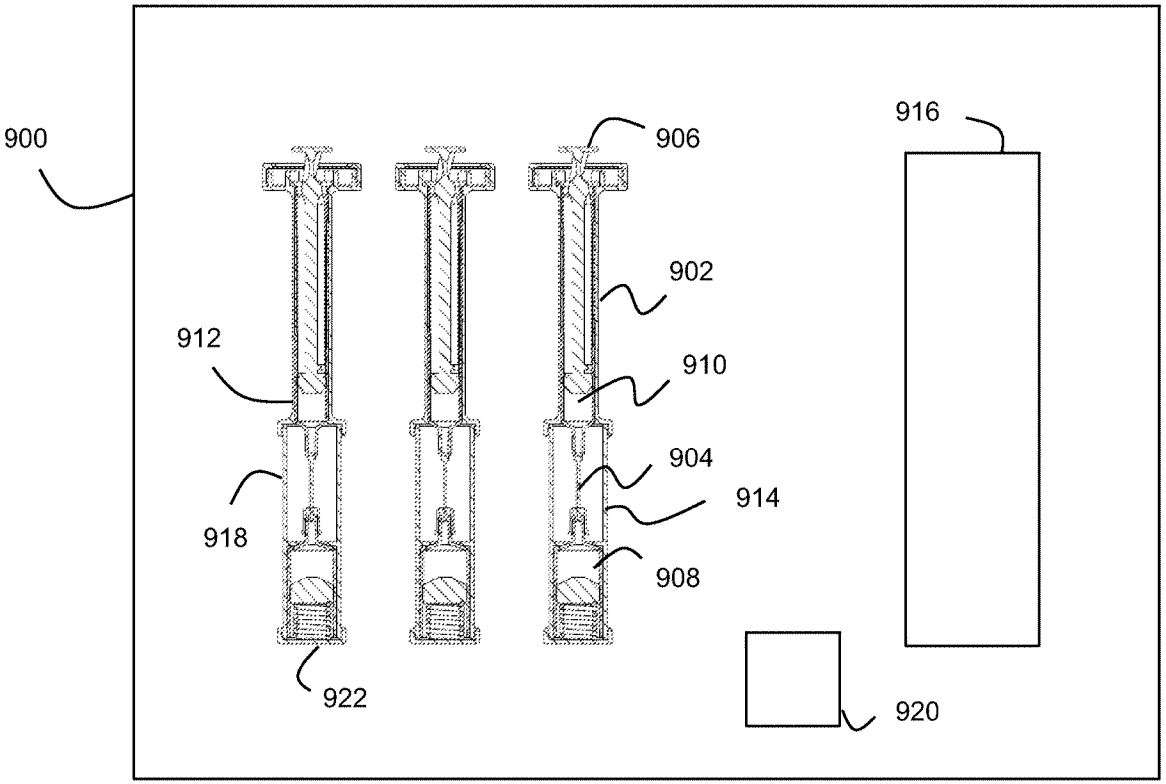
FIG. 9 shows a kit for reconstituting pharmaceuticals.

FIG. 9 shows a kit for reconstituting pharmaceuticals. In general, the kit 900 may be a complete kit that includes everything a patient needs for a single injection in one device. The kit may include an injection device, sharps container, alcohol swabs, needles, and reconstitution mechanism, in an all-in-one embodiment, and thus may constitute a "one-stop-shop" for patient injections.

The kit 900 may include a syringe 902, a needle 904 fitted to the syringe, a plunger 906 fitted to the syringe, and a vessel 908 for a reconstituting fluid. The vessel 908 may include any of the vessels for pressurized delivery of a diluent described herein. For example, the vessel 908 may include a reservoir with an opening, a seal forming a pierceable, self-sealing cover for the opening, a moving seal within the reservoir, and a stored energy mechanism configured to pressurize a fluid within the reservoir by applying a force to the moving seal.

The kit 900 may also include a pharmaceutical 910. The pharmaceutical 910 may be stored in a barrel 912 of the syringe. The pharmaceutical 910 may include a lyophilized pharmaceutical or any other pharmaceutical composition suitable for reconstitution. The kit 900 may also include a reconstituting fluid within the vessel 908 such as water, bacteriostatic water, or any other suitable diluent.

The kit 900 may also include a plurality of syringes 902. The plurality of syringes 902 may contain a corresponding plurality of predetermined dosages of the pharmaceutical selected for a particular patient.

The kit 900 may also include an alignment fixture 914 for aligning the syringe 902 to the vessel 908, such as any of the various shafts and the like described above. The alignment fixture 914 may removably and replaceably secure the syringe 902 in a location where the needle 904, when attached to the syringe 902, pierces the vessel 908 to couple a barrel 912 of the syringe 902 in fluid communication with the vessel 908 or other reservoir. The alignment fixture 914 may integrate a sharps container to enclose the needle after use. Alternatively, the kit 900 may include a separate sharps container 916 for disposal of the needle 904, or the sharps container may be integrated into another component of the kit 900. The alignment fixture 914 may, for example, include a separable sleeve 918 adapted to separate from the alignment fixture 914 and cover the needle after use.

The kit 900 may also include an antiseptic 920 that can be used to clean an injection site prior to injection of the pharmaceutical. The antiseptic 920 may include one or more of an anti-bacterial, an isopropyl alcohol, or a hydrogen peroxide. The antiseptic 920 may include an alcohol swab. In one aspect, the antiseptic 920 may be integrated into an exterior surface of the vessel 908. Thus, for example, the antiseptic 920 may be positioned on an end cap 922 and sealed with a removable sheet that can be peeled off to expose the antiseptic 920, thus improving ease of use by facilitating preparation of an injection site for single use injection with one of the syringes 902 in the kit 900.

Advantages of the devices, systems, kits, and methods described herein may include, without limitation, the elimination of drug preparation by a patient, rapid drug reconstitution, controlled dosage of injectable pharmaceuticals, convenient delivery of injectable prescriptions and so forth. In one aspect, requirements for refrigeration or other special handling are advantageously diminished by providing pharmaceuticals in a stable form for storage and transportation (e.g., lyophilized). Also, a compounding pharmacy or manufacturer may measure a drug and place a single dose within the syringe, thus eliminating patient measurement or dosing steps. The device may also be usefully packaged for a single does, disposable use. In another aspect, a fully disposable, kit-based delivery system may mitigate prescription fulfillment errors while an integrated sharps kit system facilitates disposal without special considerations.

It will be appreciated that numerous variations and adaptations of the systems and methods described above are possible. In one aspect, a device may include a dual-chambered syringe, separating the pharmaceutical and reconstitution fluid with umbrella valves or the like. In this manner, reconstitution may be incorporated within the syringe itself, with no external components. In yet another aspect, the device may include vacuum assistance. For example, a vacuum may be drawn within the syringe itself, e.g., to facilitate infiltration of the barrel of the syringe with a diluent.

It will be appreciated that the devices, systems, kits, and methods described above are set forth by way of example and not of limitation. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context.

The method steps of the implementations described herein are intended to include any suitable method of causing such method steps to be performed, consistent with the patentability of the following claims, unless a different meaning is expressly provided or otherwise clear from the context. So for example performing the step of X includes any suitable method for causing another party such as a remote user, a remote processing resource (e.g., a server or cloud computer) or a machine to perform the step of X. Similarly, performing steps X, Y and Z may include any method of directing or controlling any combination of such other individuals or resources to perform steps X, Y and Z to obtain the benefit of such steps. Thus method steps of the implementations described herein are intended to include any suitable method of causing one or more other parties or entities to perform the steps, consistent with the patentability of the following claims, unless a different meaning is expressly provided or otherwise clear from the context. Such parties or entities need not be under the direction or control of any other party or entity, and need not be located within a particular jurisdiction.

It will be appreciated that the methods and systems described above are set forth by way of example and not of limitation. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context. Thus, while particular embodiments have been shown and described, it will be apparent to those skilled in the art that various changes and modifications in form and details may be made therein without departing from the spirit and scope of this disclosure and are intended to form a part of the invention as defined by the following claims, which are to be interpreted in the broadest sense allowable by law.

What is claimed is:

1. A method comprising:

providing a syringe having a barrel and a needle;

disposing a pharmaceutical as a dry pharmaceutical composition within an interior of the barrel;

inserting a plunger into the barrel to retain the pharmaceutical within the barrel on a first end;

inserting a seal into an opening in a fluid reservoir, the seal forming a piercable, self-sealing cover for the opening, and the fluid reservoir having an interior containing an amount of fluid to reconstitute a dose of the pharmaceutical;

forming a barrier between the dry pharmaceutical composition in the interior of the barrel and the amount of fluid in the interior of the fluid reservoir;

positioning a moving seal within the fluid reservoir, wherein the seal and the moving seal isolate the amount of fluid in the interior of the fluid reservoir from environmental conditions;

pressurizing the interior of the fluid reservoir by applying a force to the moving seal with a stored energy mechanism;

placing the needle into the seal to retain the pharmaceutical within the barrel on a second end thereby providing an assembly containing the pharmaceutical, the needle having a first end and a second end and the needle in a position and orientation with the first end of the needle partially breaching the seal opposite the fluid reservoir and the second end coupled to the interior of the barrel of the syringe; and coupling an alignment fixture to the fluid reservoir and the syringe, the alignment fixture shaped and sized to retain the syringe with the needle in the position and orientation with the first end of the needle partially breaching the seal, and the alignment fixture configured to accommodate an axial movement of the syringe to pierce the barrier with the needle and couple the interior of the fluid reservoir in fluid communication with the interior of the barrel of the syringe, whereby the plunger can be depressed to drive the needle through the pierceable, self-sealing cover of the seal and release the amount of fluid from the interior of the fluid reservoir into the interior of the syringe.

2. The method of claim 1 further comprising packaging an assembly including the syringe, the fluid reservoir, and the alignment fixture for disposable single use.

3. The method of claim 2 further comprising:

removing the assembly from the packaging;

driving the needle through the seal into the fluid reservoir to couple the interior of the fluid reservoir in fluid communication with the interior of the barrel; and permitting the fluid to infiltrate the barrel thereby reconstituting the pharmaceutical and driving the plunger out of the barrel into a ready position for use in injection.

4. The method of claim 3 further comprising agitating the barrel to mix the fluid and the pharmaceutical.

5. The method of claim 3 further comprising retaining the needle through the seal until the amount of fluid stops filling the barrel.

6. The method of claim 3 wherein the amount of fluid and the pharmaceutical combine to form a reconstituted pharmaceutical at a concentration suitable for human injection.

7. The method of claim 1 wherein disposing the pharmaceutical within the interior of the barrel includes lyophilizing a pharmaceutical into the barrel of the syringe.

8. The method of claim 1 wherein the pharmaceutical includes a lyophilized pharmaceutical.

9. The method of claim 1 wherein the moving seal includes a second plunger sized to slide within the interior of the fluid reservoir while maintaining a fluid seal to retain at least some of the amount of fluid within the interior of the fluid reservoir.

10. The method of claim 1 wherein the stored energy mechanism includes a mechanical spring.

11. The method of claim 1 wherein the stored energy mechanism includes a compressible fluid pressurized to apply the force to the moving seal.

12. The method of claim 1 further comprising coupling a cap to the stored energy mechanism, the cap removably and replaceably coupled to the fluid reservoir, wherein the cap is configured to engage the stored energy mechanism with the moving seal when coupled to the fluid reservoir.

13. The method of claim 1 wherein the dry pharmaceutical composition includes a lyophilized pharmaceutical in the syringe.

14. The method of claim 13 wherein the plunger and the seal isolate the lyophilized pharmaceutical from environmental conditions.

15. The method of claim 13 wherein the lyophilized pharmaceutical includes human chorionic gonadotropin.

16. The method of claim 13 wherein the lyophilized pharmaceutical includes an immunoresponsive biologic.

17. The method of claim 16 wherein the immunoresponsive biologic includes a vaccination.

18. The method of claim 1 wherein the amount of fluid includes a bacteriostatic solvent in the fluid reservoir.

19. The method of claim 1 wherein the alignment fixture includes one or more mechanical alignment features to engage the syringe against axial displacement.

20. The method of claim 19 wherein the one or more mechanical alignment features includes one or more tabs configured to rotatably and removably engage the syringe against axial displacement within the alignment fixture.

* * * * *